United States Patent [19]

Wileman, III

[11] Patent Number: 4,697,535

[45] Date of Patent: Oct. 6, 1987

[54] MARINE SAFETY SYSTEM

[75] Inventor: Ben C. Wileman, III, Oklahoma City, Okla.

[73] Assignee: Wileman Industries, Inc, Oklahoma City, Okla.

[21] Appl. No.: 891,659

[22] Filed: Aug. 1, 1986

[51] Int. Cl.[4] ..... B63B 13/02

[52] U.S. Cl. ..... 114/183 R; 114/198; 440/1

[58] Field of Search ..... 114/182, 183 R, 183 A, 114/184, 197, 198, 212; 440/1, 84, 88

[56] References Cited

U.S. PATENT DOCUMENTS

| | | | |
|---|---|---|---|
| 2,121,664 | 6/1938 | Huckins | 114/183 R |
| 3,292,568 | 12/1966 | Morrell | 440/1 |
| 3,717,420 | 2/1973 | Rachocki | 417/12 |
| 3,850,130 | 11/1974 | Heuschober | 440/84 |
| 4,050,396 | 9/1977 | Ridgeway | 114/183 R |
| 4,275,995 | 6/1981 | Taylor | 417/40 |
| 4,341,178 | 7/1982 | Price | 114/183 R |
| 4,542,373 | 9/1985 | Hillock | 114/197 |
| 4,565,529 | 1/1986 | Aertker et al. | 114/144 E |

*Primary Examiner*—Joseph F. Peters, Jr.
*Assistant Examiner*—Stephen P. Avila

[57] ABSTRACT

A marine safety system comprising a first switch adapted to be activated by rising water in a ship's hull, and solenoid valves adapted to be operated by the switch and adapted to close sea cocks in the hull of the ship in a preferred sequence.

9 Claims, 9 Drawing Figures

MARINE SAFETY SYSTEM

BACKGROUND OF THE INVENTION

1. Field of the Invention

The invention relates to a marine safety system and is directed more particularly to a system activated by rising water in a ship's hull and operable to close the ship's sea cocks and initiate other safety measures.

2. Description of the Prior Art

It is known in the prior art to provide a bilge pump in the hull of a boat or ship and to provide means for automatically energizing the bilge pump in response to rising water in the hull.

It is also known generally to provide various electrical circuits energized by a float valve or other mechanism operable by a rising or falling water level.

SUMMARY OF THE INVENTION

An object of the present invention is to provide a safety system for boats and ships, in which rising water in the hull activates closure of the sea cocks in the hull in a preferred sequence.

A further object of the invention is to provide such a system adapted to initiate operation of other safety devices including alarms and message transmitters.

With the above and other objects in view, as will hereinafter appear, a feature of the present invention is the provision of a marine safety system comprising a switch adapted to be activated by rising water in a ship's hull, and solenoid valve adapted to be operated by the switch and adapted to close a set of sea cocks, not associated with the ship's engine, in the hull of the ship.

In accordance with a further feature of the invention, there is provided in the system a delay mechanism which operates, after the closing of the sea cocks, to shut off an engine and, thereafter, to close a second set of sea cocks associated with the engine.

In accordance with a still further feature of the invention, there is provided in the system other safety devices operable by the water activated switch, including alarm and message transmitter devices, and automatically operable bilge pumps.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
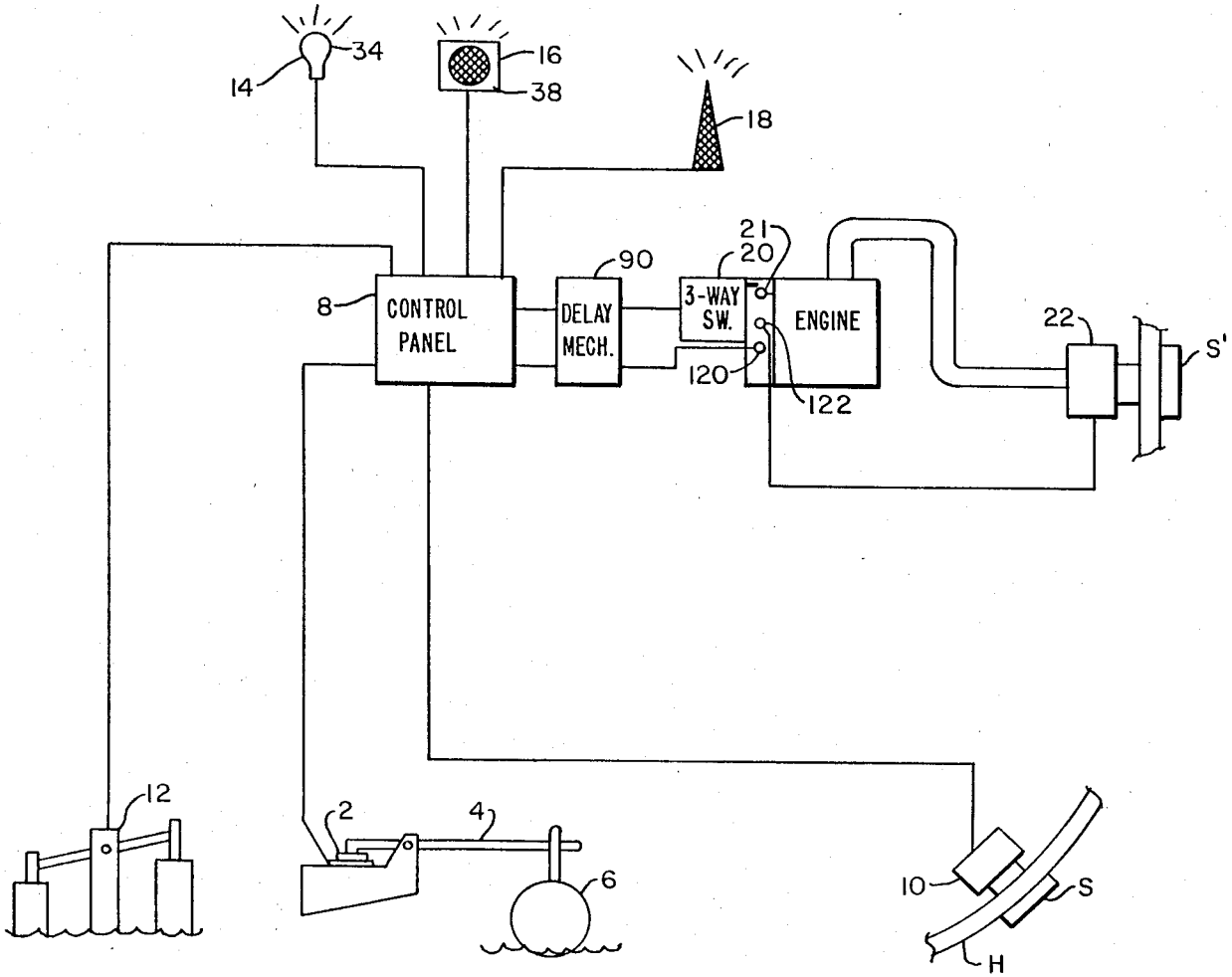
FIG. 1 is a diagrammatic view of the system.

Referring to the drawings, and particularly FIG. 1, it will be seen that the illustrative system includes a switch 2 adapted to be operated by rising water in a ship's hull H. The switch 2 may, for example, be operated by an arm 4 connected to a flotation body 6 located near the bottom of the ship's hull. It will be apparent that other mechanisms (not shown) may be employed to operate the switch 2.

The water activated switch 2 is electrically connected to a control panel 8, which may be located on the bridge of the ship, and which in turn is electrically connected to a set of solenoid valves 10, each adapted to close a sea cock S in the hull H. The control panel is also in electrical communication with a bilge pump 12, a visual alarm 14, an audible alarm 16, and a radio transmitter 18 programmed to send a message indicating danger.

The control panel 8 is further electrically connected to a three-way switch 20 having a ship's engine "off" position 21 and to a second set of solenoid valves, each valve 22 being adapted to close a sea cock S′ associated with the ship's engine. The control panel is provided with a delay mechanism, to be described below, such that the first set of sea cocks S, comprising all but the engine sea cocks S′, are closed immediately upon activation of the water activated switch 2, and after a short delay, the three-way switch 20 is positioned to shut off the engine followed by closing of the second set of sea cocks S′, comprising the engine sea cocks.

As will be further described below, the bilge pump 12 is provided with a manual switch 24 (FIGS. 2 and 3) on a control panel upper surface 26. In like manner, there is disposed on the control panel surface 26 a manual switch 28 for the radio transmitter 18, and a manual switch 30 for the three-way switch 20, engine "off" position 21.

The visual alarm 14 comprises an alarm light 32 disposed on the control panel 8 and also an external alarm light 34, which may be high on a mast head. In like manner, the audible alarm 16 comprises a small speaker 36 mounted in the control panel 8, and a larger speaker 38 mounted top-side. The control panel is provided with a manual alarm switch 40 by which an operator may select either the control panel alarm 32, 36 or the external alarms 34, 38 to be activated by the water activated switch 2.

Figure 2:
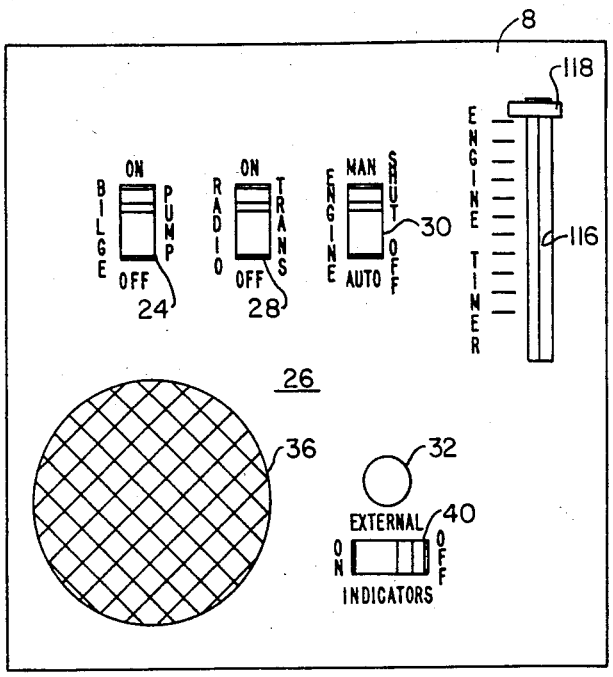
FIG. 2 is a top plan view of a control panel portion of the system.
Figure 3:
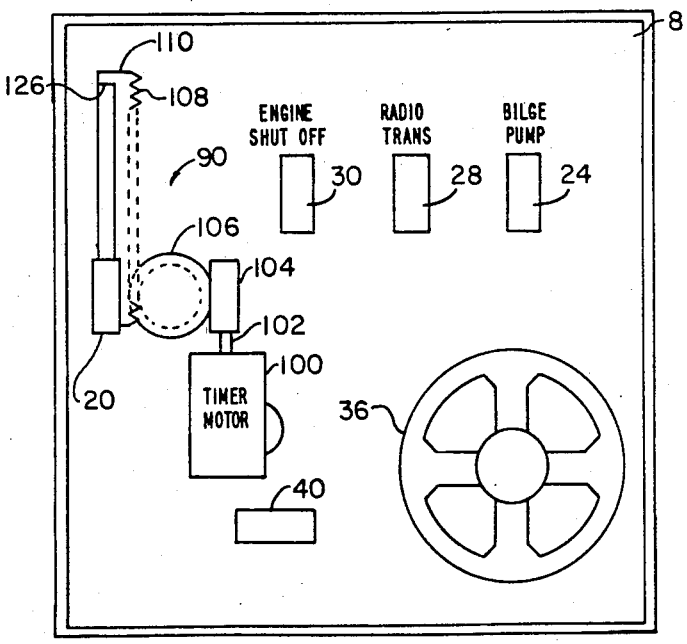
FIG. 3 is a bottom view of the control panel, with wiring omitted for clarity.
Figure 4A:
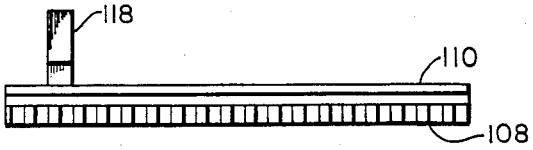
FIGS. 4*a*–4*d* are, respectively, side, top, bottom and end views of a timer bar member of the system.
Figure 4B:
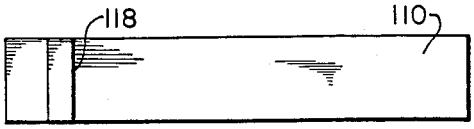
Figure 4C:
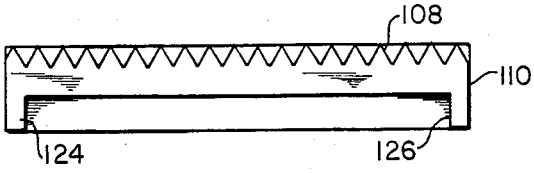
Figure 4D:
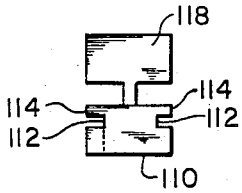
Figure 5:
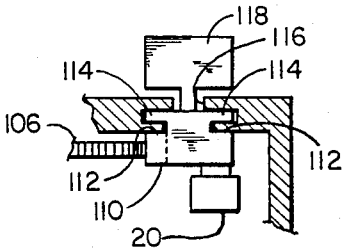
FIG. 5 is an end view similar to FIG. 4*d*, but showing the timer bar in place in the control panel.
Figure 6:
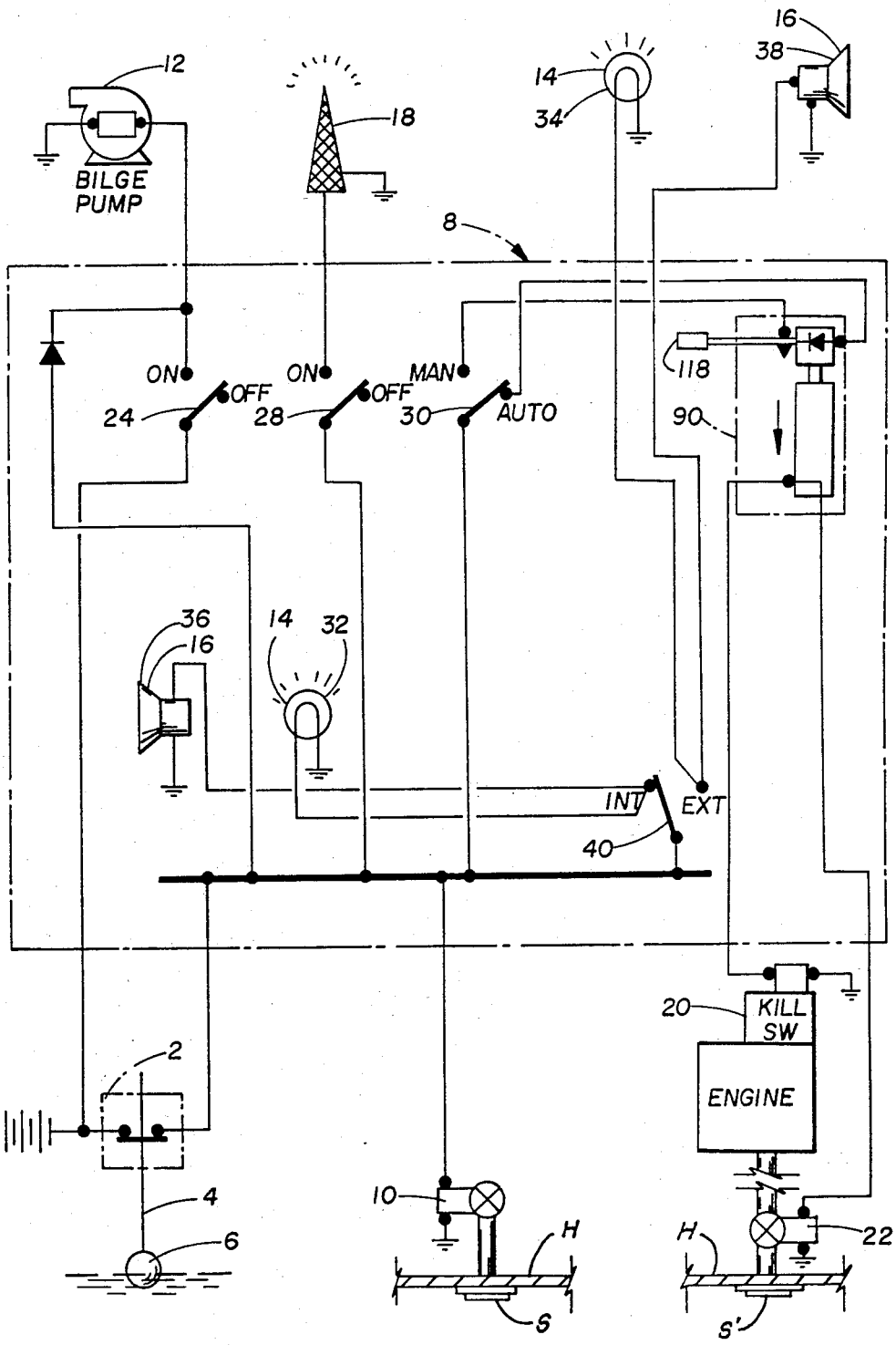
FIG. 6 is an electrical circuit diagram, illustrative of the circuitry of a preferred embodiment.

Mounted in the control panel 8 is a delay mechanism 90 (FIG. 3) including a timer motor 100 having a spindle 102 extending from the central axis thereof. A gear 104 is mounted on the spindle 102 and rotatable therewith. The gear 104 is engaged with a timer bar gear 106 which, in turn, is engaged with a gear track 108 disposed on a side of a timer bar 110. The timer bar 110 is provided with opposed grooves 112 (FIG. 4*d*) on either side thereof formed in part by outwardly extending flanges 114. The timer bar grooves and flanges 112, 114 are slidably adjacent complementarily shaped portions of the control panel upper plate 26 (FIG. 5) defining an elongated slot 116 (FIG. 2). A handle 118 extends from an upper portion of the timer bar and through the slot 116 so as to be accessible to an operator. The three-way switch 20 mounted proximate the timer bar, and besides the engine cut-off position 21, is provided with an engine sea cock closing position 122, and a drive motor disconnect position 120. The side of the timer bar opposite the gear track 108 is provided with first and second lugs 124, 126 (FIG. 4*c*) which are adapted to actuate the switch 20.

In operation, a rise in water level in the ship's hull H will raise the flotation body 6, causing the arm 4 to activate the switch 2. Closing the switch 2 delivers current to the first set of solenoid valves 10 to close all sea cocks S in the hull not associated with the ship's engine. Current is further delivered to the manual alarm switch 40, which is selectively positioned either "on" or "off" for external alarms. If the switch 40 is in the "on" position, the external visual and audible alarms 34, 38 are activated, as for example, to show a blinking light from a mast head area and sound alarms above and below decks. If the switch is "off", current is directed to the control panel alarms 32, 36.

Activation of the switch 2 also delivers electrical current to the bilge pump 12. The bilge pump 12 is also provided with its own circuit (not shown) for operation independently of the safety system, when the switch 24 is in the "off" position.

Activation of the switch 2 further delivers electrical current to the engine shut off switch 20. If the manual switch 30 is in the "automatic" setting, current will flow to the timer motor 100. If the switch 30 is on the "manual" position, current will not flow to the motor 100. Current flowing to the timer motor 100 of the delay mechanism 90, turns the spindle 102, and the gears 104, 106, to cause linear movement of the timer bar 110. Movement of the timer bar 110 causes the timer bar lug 124 to engage the three-way switch 20 to position the switch 20 in the engine "off" position to shut down operation of the ship's engines. Continued movement of the timer bar 110 causes the timer bar lug 126 to engage the three-way switch 20 to position the switch 20 in its engine sea cock closing position 122, which activates a second set of solenoid valves 22 which are operable to close all sea cocks S' related to the ship's engines. Finally, the lug 126 further engages the three-way switch 20 to locate the switch 20 in its drive motor disconnect position 120, to stop operation of the timer motor 100.

Activation of the switch 2 still further delivers electrical current to the radio transmitter switch 28 mounted on the control panel 8, which switch may be set in an "on" or "off" position. If "off", the radio transmitter is unaffected by the water activated switch 2. If the radio transmitter switch 28 is in the "on" position, the radio transmitter 18 is activated and caused to broadcast a selected message warning of danger on board ship.

The control panel is provided with the aforementioned manual engine shut off switch 30, which may be set on "manual" or "automatic". If turned to "manual", the engine is unaffected by the activation of the switch 2 and is adapted to be shut off manually. If the switch 30 is left in the "automatic" position, electrical current from the switch 2 will shut down the engine, after operation of the timer bar 110. An operator also has the option of expediting movement of the timer bar by manual movement of the handle 118, insuring that the proper sequence of events takes place, but on a faster basis. In the same manner, an operator may shut off the engine if the switch 30 is set on "manual".

Thus, if the external indicator switch 40 is on "on", the bilge pump switch 24 is on "on", the radio transmitter switch 28 is on "on" and the engine shut off switch is in the "automatic" position, activation of the switch 2 causes (1) the external visual and audible alarms 34, 38 to operate, (2) the bilge pump 12 to operate, (3) the radio transmitter 18 to broadcast a programmed message, (4) all non-engine sea cocks S to be closed by the first solenoid valves 10, (5) the ship's engines to shut off, and (6) after the engines have been shut off, all sea cocks S' associated with the ship's engines to be closed by the second solenoid valves 22.

The various switches provide the ship's crew with a number of options. If underway, or if otherwise but with the bridge manned, the external alarms switch 40 would normally be "off", with the control panel alarms 32, 36 sufficing. If a crew is aboard, the tradio transmitter switch 28 would normally be "off". If the crew is close ashore the external alarms, particularly the light 34 at mast head height, would be helpful in providing a short range visual signal that the ship was taking on water. If a single watch station ashore is watching over several vessels, the radio transmitter switch left on the "on" position could quickly alert watch personnel and identify the particular vessel experiencing trouble.

It is to be understood that the present invention is by no means limited to the particular construction herein disclosed and/or shown in the drawings, but also comprises any modification or equivalents within the scope of the disclosure.

Having thus described my invention, what I claim as new and desire to secure by Letters Patent of the United States is:

1. A marine safety system comprising a first switch adapted to be activated by rising water in a ship's hull, first solenoid valves adapted to be operated by said first switch and adapted to close a first set of sea cocks in said hull of said ship, and a delay mechanism, the operation of which is initiated by said first switch, said delay mechanism being electrically connected to an engine shut off switch and to a second set of solenoid valves adapted to close a second set of sea cocks associated with an engine of said ship.

2. The marine safety system according to claim 1, in which said system further comprises an alarm means adapted to be activated by said first switch.

3. The marine safety system according to claim 2, in which said alarm means comprises audible and visual alarm means.

4. The marine safety system according to claim 1, in which said system further comprises a bilge pump adapted to be activated by said first switch.

5. The marine safety system according to claim 1, in which said system further comprises a radio transmitter programmed to transmit a selected signal and adapted to be activated by said first switch.

6. The marine safety system according to claim 1, in which said delay mechanism comprises a motor activated by said first switch, a timer bar moveable in response to the operation of said motor, said timer bar being operable after a first extent of movement to close said engine shut off switch to terminate operation of said engine, said timer bar being operable after a further extent of movement to close an engine sea cock switch which in turn operates said second set of solenoid valves to close said second set of sea cocks.

7. A marine safety system comprising a switch adapted to be activated by rising water in a ship's hull, first solenoid valve means adapted to be operated by said switch and adapted to close a first set of sea cocks in said hull of said ship, a delay mechanism activated by said switch, said delay mechanism operable to shut off an engine of said ship, and second solenoid valve means adapted to be operated by said delay mechanism, after shutting off said engine, said second solenoid valve means being adapted to close a second set of sea cocks in said hull, said second set of sea cocks being associated with said engine.

8. The marine safety system according to claim 7, and further comprising alarm means, said alarm means being adapted to be operated by said switch.

9. The marine safety system according to claim 7, in which said delay mechanism includes an electrical drive motor operable by said switch and adapted to cause linear movement of a timer bar member adapted to operate in turn an engine shut off switch and said second solenoid valve means, said timer bar member being adapted for manual movement by an operator.

* * * * *